US010581198B2

(12) United States Patent
Seido

(10) Patent No.: US 10,581,198 B2
(45) Date of Patent: Mar. 3, 2020

(54) CONNECTOR

(71) Applicant: WITCO JUPITER DENTSU CO., LTD., Ota-ku, Tokyo (JP)

(72) Inventor: Toshiyuki Seido, Tokyo (JP)

(73) Assignee: WITCO OF JUPITER DENTSU CO., LTD., Tokyo (JP)

( * ) Notice: Subject to any disclaimer, the term of this patent is extended or adjusted under 35 U.S.C. 154(b) by 0 days.

(21) Appl. No.: 16/265,347

(22) Filed: Feb. 1, 2019

(65) Prior Publication Data

US 2019/0245303 A1 Aug. 8, 2019

(51) Int. Cl.
*H01R 13/631* (2006.01)
*H01R 13/629* (2006.01)

(52) U.S. Cl.
CPC ..... *H01R 13/631* (2013.01); *H01R 13/62905* (2013.01)

(58) Field of Classification Search
CPC ..... H01R 13/631; H01R 13/62905; H01R 13/5219; H01R 13/622; H01R 4/301
USPC ..... 439/376, 320, 321, 357
See application file for complete search history.

(56) References Cited

U.S. PATENT DOCUMENTS

| | | | | |
|---|---|---|---|---|
| 6,848,930 | B2 * | 2/2005 | Fukuda | H01R 13/6277 439/271 |
| 7,824,204 | B2 * | 11/2010 | Fujiwara | H01R 13/5219 439/311 |
| 8,591,422 | B2 | 11/2013 | Harshman et al. | |
| 8,747,166 | B2 | 6/2014 | Yamada et al. | |
| 9,502,833 | B2 * | 11/2016 | Sekino | H01R 13/62905 |
| 9,742,139 | B2 * | 8/2017 | Small | H01R 43/26 |
| 2008/0233773 | A1 | 9/2008 | Meleck | |
| 2014/0357114 | A1 | 12/2014 | Pankau et al. | |
| 2017/0062978 | A1 | 3/2017 | Seido | |
| 2018/0323541 | A1 | 11/2018 | Seido | |

FOREIGN PATENT DOCUMENTS

| | | | |
|---|---|---|---|
| EP | 0 597 531 | A1 | 5/1994 |
| JP | 2009-525588 | A | 7/2009 |
| JP | 2010-118224 | A | 5/2010 |
| JP | 2011-249012 | A | 12/2011 |
| JP | 5852296 | B1 | 12/2015 |
| JP | 2017-004664 | A | 1/2017 |
| WO | 2007/090066 | A2 | 8/2007 |
| WO | 2016/170605 | A1 | 10/2016 |

* cited by examiner

*Primary Examiner* — Hien D Vu
(74) *Attorney, Agent, or Firm* — Davis & Bujold PLLC; Michael J. Bujold

(57) ABSTRACT

A connector is provided in which, only inserting a plug and a socket with each other, a plug body and a socket body are rotated relative to each other around a center axis line to a regular position, and the overall outer diameter of the connector can be reduced.

An outward protrusion 9 is provided on an outer peripheral surface of the distal end portion of an insertion portion 7 of a plug body 4, a plurality of inward ridges 17 extending in an axial direction facing are provided on the inner surface of a cylindrical portion 8 of a socket body 6, a groove 16 through which the outward protrusion 9 can pass is formed between each of the adjacent ridges 17, and an inclined cam surface 18 is provided on the inner surface of the cylindrical portion 8 closer to the proximal end portion than the ridge 17, so that the protrusion 9 can slidably contacts and guides the plug body 4 to a regular position.

10 Claims, 7 Drawing Sheets

CONNECTOR

TECHNICAL FIELD OF THE INVENTION

The present invention relates to a connector connected by inserting a plug and a socket in an axial direction to each other.

BACKGROUND OF THE INVENTION

In such a conventional connector, if mutual directions of the plug and the socket around a center axis of the connector are different when the plug and the socket are connected, there is a possibility that electrical connection relationship of them may be varied or connection pins may be broken. So that, it is desirable that the mutual directions of the plug and the socket around the center axis of the connector at the time of connection always coincide.

In order to make easy positioning around the center axis at the time of connecting such a plug and a socket, a connector that an erroneous insertion prevention key is provided in either one of the plug and the socket (a first connector and a second connector) and the other of them is provided with a spiral extending slope for guiding the erroneous insertion preventing key and a key receiving part connected to the end of the extending slope is known (For example, JP 2010-118224 A)).

Moreover, another connector is known that is, an inclined cam surface and a cam follower are provided on opposing faces of the plug and the socket so as to face each other when the plug and the socket are mutually inserted in the axial direction, and the inclined cam surface and the cam follower are brought into sliding contact with each other, whereby the plug and the socket are relatively rotated and are positioned with respect to each other in the direction of rotation about the center axis. Further, a pin insertion hole is provided at the center of either one of the opposing faces of the plug and the socket, and a center pin protrudes at the center of the other of the opposing faces is provided, and when the plug and the socket are mutually inserted in the axial direction, the center pin is fitted into the pin insertion hole before the inclined cam surface and the cam follower come into contact with each other (For example, US 2017/0062978 A1).

SUMMARY OF THE INVENTION

However, in the connector described in JP 2010-118224 A, when trying to connect the plug and the socket (the first connector and the second connector) in a state that the plug and the socket are not aligned in a straight line, a tip edge of the plug or socket or the erroneous insertion prevention key abuts against another tip edge etc. of the other side, which may cause wear, breakage or the like.

Moreover, according to the connector described in US 2017/0062978 A1, in the initial stage of connection between the plug and the socket, after the center pin is inserted into the pin insertion hole and the axis of the plug and the socket are aligned with each other, the plug and the socket are smoothly inserted into the socket. Therefore, there is an advantage that it is possible to prevent abrasion and breakage due to partial contact between the plug and the socket. However, the outer diameter of the center pin must be increased in order to ensure the necessary strength of the center pin. Along with this, there is a problem that the overall outer diameter of the connector becomes larger.

Particularly, in a round type connector for a multi-core cable in which large number of connector pins to be arranged around the center pin are required, it is difficult to make both the increase in the number of pins and the reduction in the overall outer diameter of the connector compatible.

In view of the above-described problems of the prior art, it is an object of the present invention to provide a connector in which, by merely inserting a plug and a socket without worrying about their directions around a center axis, a plug body and a socket body are rotated relatively to each other about the center axis so as to move to a regular position, and the overall outer diameter can be reduced.

According to the present invention, the subject is solved as follows.

(1) In a connector comprising a plug having a plug body and a socket having a socket body, wherein the plug and the socket are connected to each other by inserting them in an axial direction, wherein either one of the plug body and the socket body is a male body provided with an insertion portion having a circular outer peripheral surface, and the other is a female body provided with a cylindrical portion into which the insertion portion of the male body can rotatably fit, wherein an outward protrusion is provided on a part of outer peripheral surface of a distal end portion of the insertion portion of the male body, wherein a plurality of inward ridges and an inclined cam surface are provided on an inner surface of the cylindrical portion of the female body, wherein a groove through which the outward protrusion can pass in the axial direction is formed between each of the adjacent ridges, wherein, when the insertion portion is inserted into the cylindrical portion in the axial direction and the outward protrusion contacts with the inclined cam surface, the male body and the female body are relatively rotated and are positioned at a regular position in a rotational direction around a center axis line of the connector, and wherein a plurality of electrical, optical or fluid connecting means are respectively provided at an opposing portion of the male body and the female body and those connecting means are connected to each other in a state in which the male body and the female body are positioned at a regular position.

According to such a configuration, when the plug and the socket are mutually inserted in the axial direction, first of all, the outward protrusion of the insertion portion of the male body enters into one of a plurality of grooves between the plurality of ridges provided on the inner surface of the cylindrical portion of the female body, so that the male body and the female body can be fitted smoothly in a state where they are aligned.

Then, if the plug and the socket are inserted further deeply, the projecting portion of the insertion portion of the male body abuts against the inclined cam surface of the cylindrical portion of the female body and slides along the inclined cam surface. As a result, the male body and the female body are rotated relative to each other to a regular position around their center axis. When the male body and the female body rotate relative to each other to the regular position around the center axis line, the connecting means can properly be connected in a regular positional relationship.

Therefore, when the plug is inserted into the socket in any direction by a worker, the plug body and socket body are smoothly guided to the regular position, and the connecting means can be correctly connected properly. So that, even if the worker can't visually recognize the connection point between the plug and the socket, it is possible to easily and quickly perform the connection work of the plug and the socket. It can connect even by a fumbling operation.

In addition, before the projection of the insertion portion of the male body abuts against the inclined cam surface of the cylindrical portion of the female body, the protrusion of the male body has already been entered into one of the grooves formed between the plurality of protrusions on the inner surface of the cylindrical portion of the female body some extent, and the mutual inclination of the male body and the female body are corrected and the centering is performed. So that, the protrusion of the male body can always abut against the inclined cam surface of the female body in a fixed posture. Therefore, abrasion, breakage, etc. due to partial contact at the time of insertion between the male body and the female body can be prevented.

Furthermore, it is unnecessary to provide a large diameter center pin or pin insertion hole as described in US 2017/0062978 A1 on the distal end face of the insertion portion of the male body and the opposing face of the cylindrical portion of the female body, so that the entirety of these opposing faces can be used for the connecting means and the overall outer diameter of the connector can be reduced.

(2) A connector comprising a plug, a socket, connecting means, and a cylinder tube, the plug has a cylindrical insertion portion, the socket is configured to be connected to the plug by inserting the insertion portion in the axial direction, the connecting means is an electrical, an optical or a fluid connecting means provided at each of opposed portions of the plug and the socket, wherein the cylinder tube is connected to at least one of the plug and the socket rotatable around the axial direction, wherein the plug has an outward protrusion protruding outward from a part of an outer peripheral surface of the insertion portion, wherein the socket has a cylindrical portion, a plurality of inwardly extending ridges provided on an inner peripheral surface of the cylindrical portion, and an inclined cam surface provided on an inner peripheral surface of the cylindrical portion, the cylindrical portion is configured such that the insertion portion can be inserted in the axial direction while rotating around the axis line, wherein, between each of the adjacent ridges, a groove through which the outward protrusion can pass in the axial direction is formed, wherein, when the insertion portion is inserted in the cylindrical portion in the axial direction, the protrusion slidably contacts with the inclined cam surface and the socket is rotated relative to the plug so that the socket and the plug are positioned at a regular position in a rotational direction around a center axis line, and wherein, when the plugs and the socket are positioned at the regular position, the connecting means are connected to each other, and wherein the cylinder tube has a predetermined length in the axial direction such that any electrical, optical or fluid conducting means connected to the connecting means can be passed through the cylinder tube.

With such a configuration, in addition to the operation and effect detailed in (1) above, even if the plug and the socket are provided at a deep place, it is possible to easily perform the connection work by gripping the cylinder tube longer than the plug and the socket. Furthermore, by inserting the conducting means into the cylinder tube, when the conducting means is made of an optical hard fiber or the like, even if the optical fiber is provided as a single wire without using a multi-core optical connecting cable, since the optical fibers are not scattered, it is possible to reduce the cost.

(3) The connector according to (1), at least one of the plug body and the socket body is provided rotatable around a center axis of a cylindrical case and incapable of relatively moving in the central axial direction.

According to such a configuration, when connecting/disconnecting the plug body and the socket body while gripping the case, the relative rotation of the plug body and the socket body is absorbed in the case. Since the plug body or the socket body rotates independently within the case, there is no need to rotate or twist worker's fingers holding the plug body or the socket body for following the rotation, therefore, connecting/disconnecting work is facilitated.

(4) The connector according to (2), wherein a connecting member capable of rotating on the outer peripheral surface of the distal end portion around the axis line is provided at the distal end portion of the cylinder tube, and wherein, in a state where the plug and the connector are connected to each other, the connecting member is engaged with an engaging portion provided in the plug or the connector in the axial direction.

With such a configuration, the plug and the connector can be firmly connected to each other. In a state where the plug and the connector are connected to each other, since the connecting portion between the plug and the connector is covered with a labyrinth structure, the connection It is possible to make the part inconspicuous and to reliably prevent the entry of dust, liquid or the like into the inside of the connection part.

(5) The connector according to (1) or (2), the distal end portions of each of the ridges is formed a sharp pointed shape and the distal end portions of the grooves formed between the adjacent ridges are expanded in the circumferential direction of the cylindrical portion of the female body.

According to such composition, when the insertion portion of the male body is first inserted into the cylindrical portion of the female body, the protrusion of the male body can be smoothly distributed to any one of the grooves on both sides of the ridge and can be guided.

(6) The connector according to any one of (1)-(5), a clearance in the axial direction is provided between the ridges on the inner surface of the cylindrical portion of the female body and the inclined cam surface so that the protrusion can pass in the circumferential direction of the cylindrical portion.

According to such a configuration, after the protrusion of the insertion portion in the male body has passed through the groove between the ridges on the inner surface of the cylindrical portion of the female body, the protrusion is moved along the inclined cam surface of the female body when sliding, and the sliding is not disturbed by the ridges.

(7) The connector according to any one of (1)-(6), at least one of the plurality of ridges is continuous with a top portion of the inclined cam surface.

According to such composition, the protrusion which is guided along either side of the ridge that is continuous with the top portion of the inclined cam surface is continuously guided smoothly along the inclined cam surface as it is.

Moreover, since the gap between all ridges and the inclined cam surface in the cylindrical portion of the female body can be made small, the length in the axial direction of the female body can be reduced.

(8) The connector according to any one of (1)-(7), the connecting means comprises: one or a plurality of pins provided on one of the opposing faces of the plug body and the socket body and facing in the axial direction, and one or a plurality of receiving members provided on the other of the opposing faces and configured partially in contact with the respective pins.

According to such composition, since many pins and receiving members can be provided on the opposing faces, it is suitable when there are many electrical connection systems such as multi-core cable connection, for example.

According to the present invention, since just by inserting the plug and the socket into each other without worrying about their direction around the center axis, the outward protrusion slidably contacts the inclined cam surface, so that the plug body and the socket body are relatively rotated around the center axis line to the regular position, thus, it is possible to provide a connector in which the overall outer diameter is reduced.

DETAILED DESCRIPTION OF THE EMBODIMENTS

Hereinafter, a first embodiment of a connector of the present invention will be described with reference to accompanying drawings.

Figure 1:
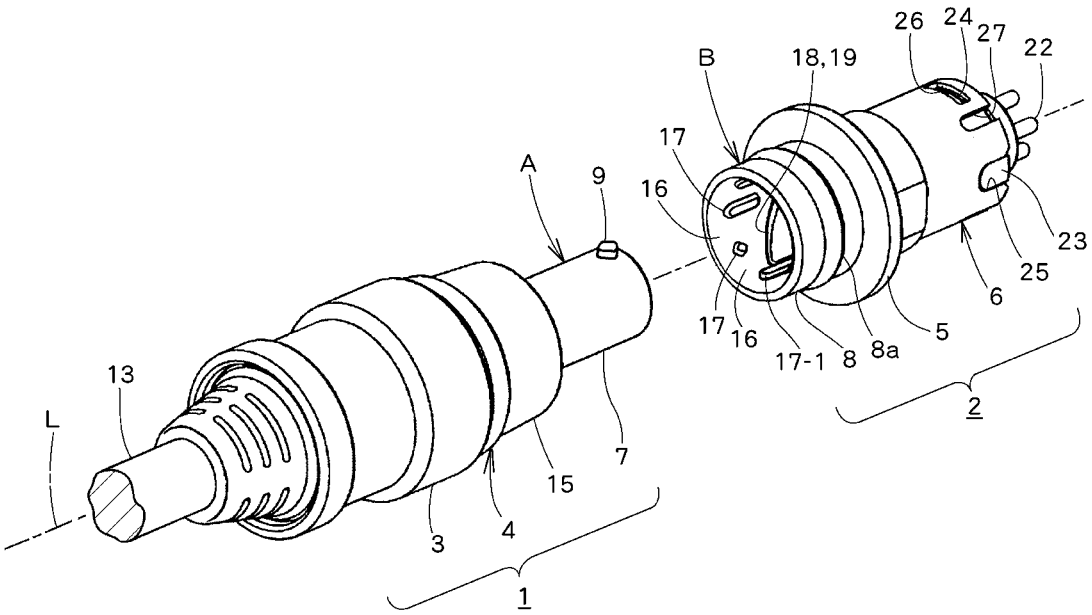
FIG. 1 is a perspective view of a connector according to a first embodiment of the present invention showing a state in which a plug and a socket are separated from each other.
Figure 2:
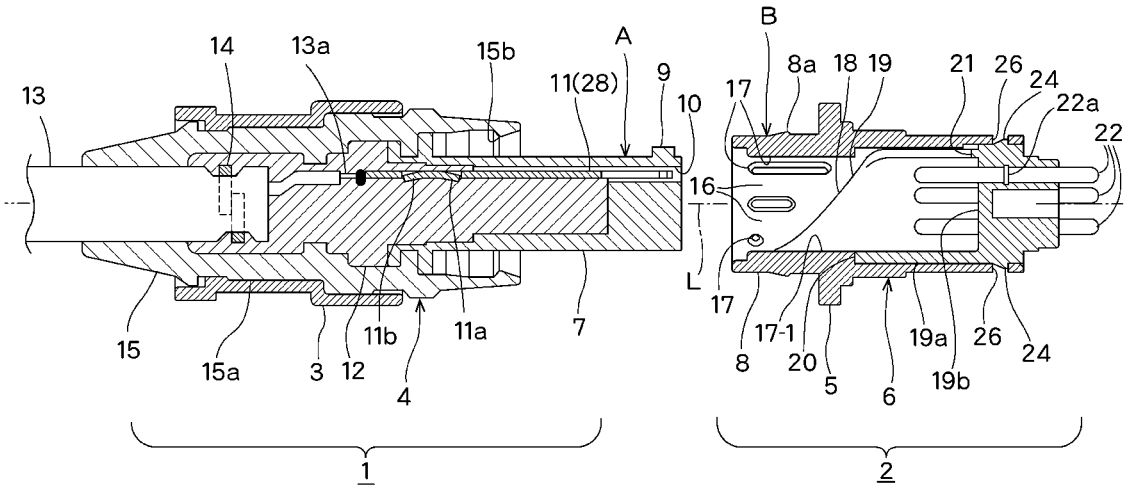
FIG. 2 is a central vertical sectional front view of the connector.

The connector is connected by inserting a plug 1 and a socket 2 each other in an axial direction, as shown in FIGS. 1 and 2. (In FIGS. 1 and 2, it is shown that both of central axes of the plug 1 and the socket 2 coincide with a center axis line L of the connector). The plug 1 has a cylindrical plug case 3 and a plug body 4. The plug body 4 is retained in the plug case 3 in a state in which its intermediate portion can rotate and can't move in the direction of the center axis line L. The socket 2 has a substantially cylindrical socket body 6 with an enlarged collar part 5 in the middle portion.

The plug body 4 is a male body A having a columnar inserting portion 7 with a circular outer peripheral surface. The socket body 6 is a female body B having a cylindrical portion 8 into which the inserting portion 7 of the male body A can rotatably fit. In addition, it is also possible to use the plug body 4 as a female body B, and to use the socket body 6 as a male body A.

An outward protrusion 9 is provided on the plug body 4. That is, at a portion of the outer peripheral surface of the distal end portion of the inserting portion 7 of the male body A, the protrusion 9 is provided.

In the present embodiment, the cross section of the protrusion 9 is a rhombic shape, but instead of this, the protrusion may have a circular shape, a triangular shape, or another shape. In any of the shapes, it is preferable that the distal end portion and the proximal end portion in the direction of the center axis line L have a sharp pointed shape.

Figure 3:
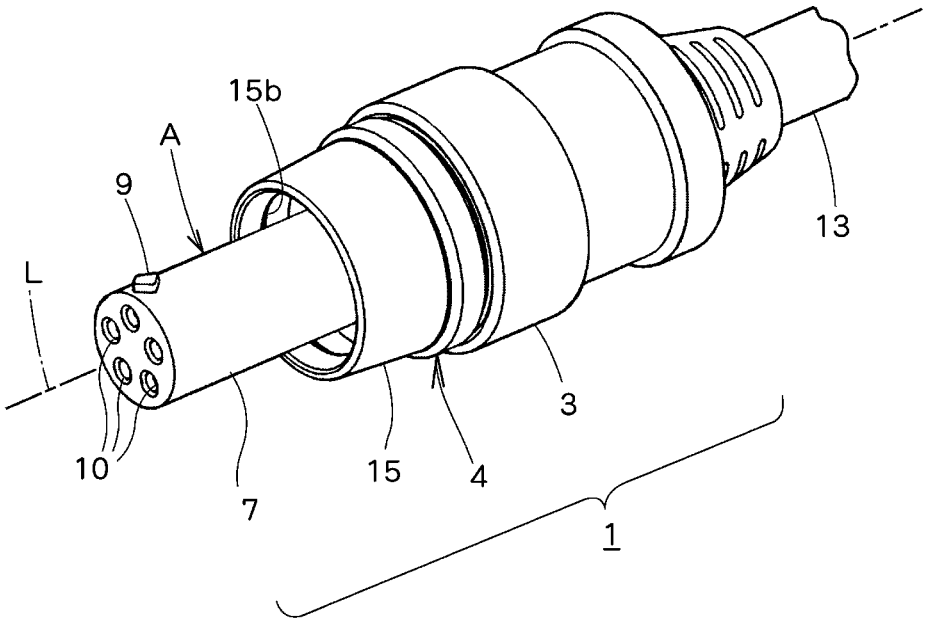
FIG. 3 is a perspective view which looked at the plug from the direction contrary to FIG. 1.

As shown in FIG. 3, five pin insertion holes 10 are formed on the distal end face of the inserting portion 7 in parallel with the axis line L equally in the circumferential direction. The pin insertion holes may be formed unequally.

Figure 4:
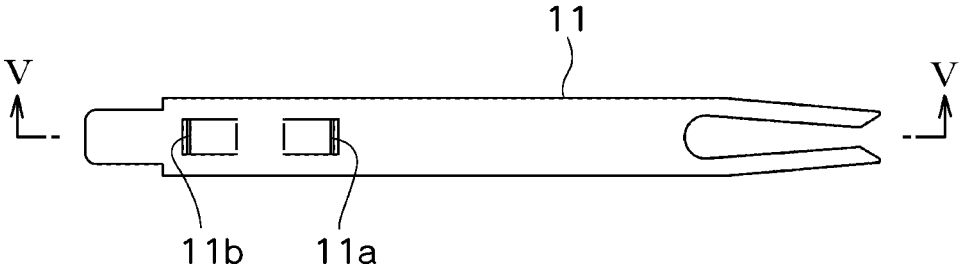
FIG. 4 is a plan view of a female contactor of the connector.
Figure 5:
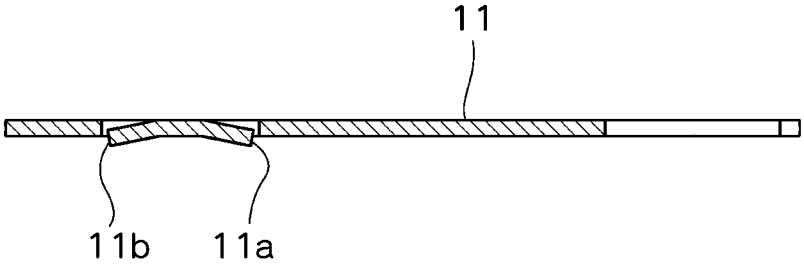
FIG. 5 is a vertical sectional front view taking along the V-V line in FIG. 4.

In each pin insertion hole 10 of the plug body 4, a female contactor 11 of plate shape which constitutes a receptacle component, as shown in FIGS. 4 and 5, is installed. As for these female contactors, each base is firmly held by a contactor holding member 12 in the plug body 4.

Two projections for retaining 11*a*, 11*b* are formed near both end portions of the female contactor 11 by cutting and raising a part of the female contactor diagonally.

As shown in FIG. 4, the both end portion of each female contactor 11 is bifurcated. A pin 22 which has inserted into each pin insertion hole 10 and which is mentioned later is inserted in the bifurcated part of the female contactor. By insertion, the bifurcated part is expanded by elastic deformation and the pin 22 is contacted so that electrical connection is secured.

Figure 10:
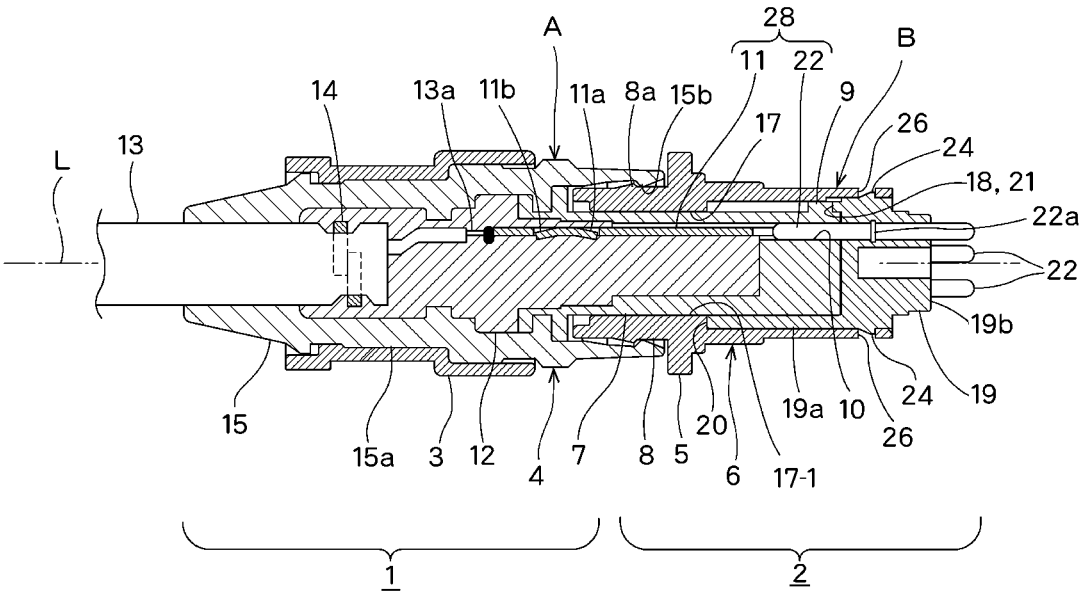
FIG. 10 is a central vertical sectional front view of the connector taking along the X-X line in FIG. 9.

As shown in FIGS. 2 and 10, the terminal of a core wire 13*a* is connected to the end portion of each female contactor 11 by soldering etc. in the contactor holding member 12. This core wire is a coated lead wire led out from the terminal of the multi-conductor cable 13 into the plug body 4.

A retaining bracket 14 is formed in the terminal part of the multi-conductor cable 13.

A cylindrical outer tube 15 covers the base of the inserting portion 7, the contactor holding member 12 and the terminal part of the multi-conductor cable 13 of the plug body 4.

A small diameter portion 15*a* is formed in the intermediate part of the peripheral surface of the outer tube 15, and the plug case 3 is fitted to the small diameter portion from the outside rotatable and immovable in the direction of the center axis line L.

The outer tube 15 covers the base portion of the inserting portion 7 with a predetermined gap, and an inwardly facing annular projection 15*b* having a chevron shape cross sectional is provided on the inner surface of the distal end portion of the outer tube.

Each female contactor 11 of the plug body 4 is made of conductor, and the other component of the plug body is made of insulator, preferably made of synthetic resin material.

According to this embodiment, the plug body 4 is composed of the inserting portion 7, five female contactors 11, the contactor holding member 12, and the outer tube 15. However, the plug body may be composed of many components. For example, the contactor holding member 12 and the outer tube 15 are formed by combining a plurality of members. In order to simplify the explanation, they will be described as a single body here. The same may be said of the socket body 6 mentioned later.

As shown in FIGS. 1 and 2, on the outer peripheral surface of the distal end portion of the cylindrical portion 8 of the socket body 6, an outwardly facing annular projection 8*a* having a chevron cross sectional is provided. When the distal end portion of the cylindrical portion 8 is inserted into a space between the inserting portion 7 and the distal end portion of the outer tube 15 of the plug body 4, the outwardly extended annular projection is elastically engaged with the inwardly facing annular projection 15*b* on the inner surface of the outer tube 15.

Figure 7:
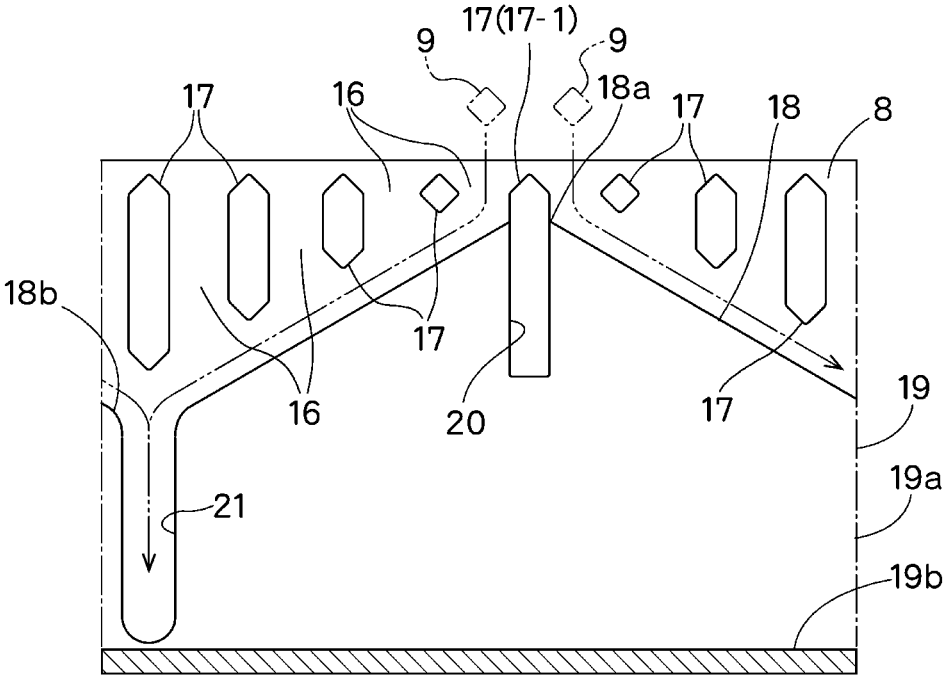
FIG. 7 is a developed view of the cylindrical portion and the inner tube.

As shown in FIG. 7, near the tip of the inner peripheral surface of the cylindrical portion 8 of the socket body 6, a plurality of inward ridges 17 along the axial direction of the center axis line L in which grooves 16 are formed between them is provided. Through the groove 16, the protrusion 9 on the plug body 4 side can pass. An inclined cam surface 18 is provided in the socket body located closer to the base end portion of the socket body than the respective ridges 17. When the inserting portion 7 is inserted into the cylindrical portion 8 in the axial direction, the protrusion 9 slidably contacts on the inclined cam surface 18 as a cam follower. Thereby, the male body A and the female body B are rotated relatively, and they are positioned mutually in the regular position of the direction of rotation of the circumference of the axis line L.

In the embodiment shown in FIG. 7, the number of ridges 17 is eight and each ridge 17 is formed integrally with the cylindrical portion 8. The width of the groove 16 is equal to or slightly larger than the width of the protrusion 9 (the width of the circumferential direction of the inserting portion 7).

The lengths of the ridges 17 of the cylindrical portion 8 in the direction of the center axis line L are different from one another in the relationship to be described later. Both ends of each ridge in the center axis line L direction are made into the sharp pointed shape (The proximal end of the longest ridge 17-1 is excluded).

Since the tip end portion of the respective ridge 17 is formed into the sharp pointed shape, the distal end portion of the groove 16 formed between ridges 17, 17 which adjoin mutually is expanded in the circumferential direction of the cylindrical portion 8 of the female body B. Thereby, when the inserting portion 7 of the male body A is first inserted into the cylindrical portion 8 of the female body B, the protrusion 9 of the male body A is inserted into any one of the grooves 16 on both sides of each ridge 17 so that it can be distributed and guided smoothly.

As for the inner surface of the distal end portion of the cylindrical portion 8, it is desirable to cut off the corners including each ridge 17 for expanding toward the tip.

Figure 6:
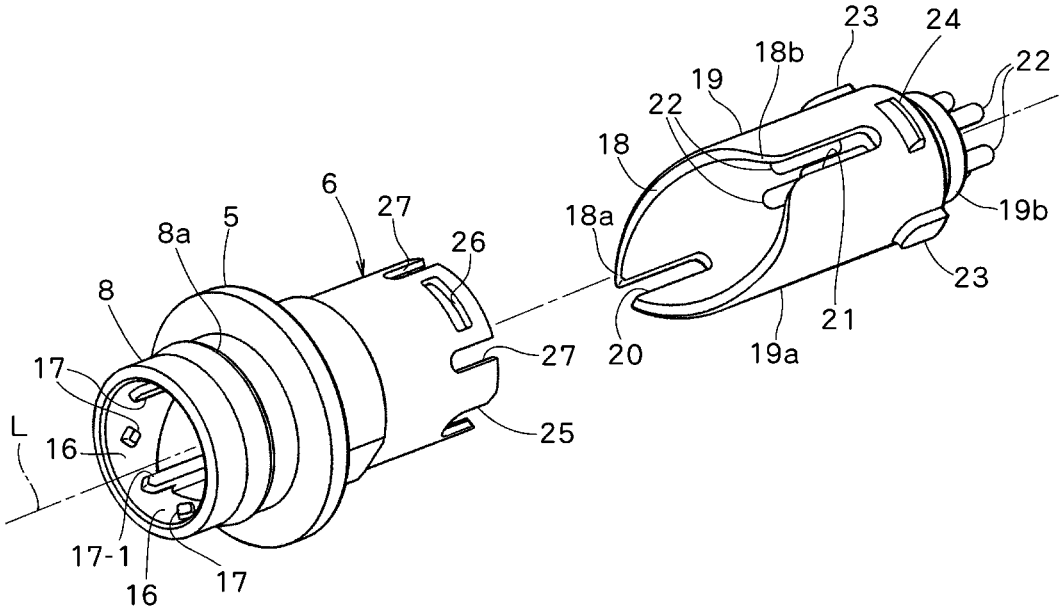
FIG. 6 is an exploded perspective view of a cylindrical portion and an inner tube of the connector of the embodiment shown in FIG. 1.

As shown in FIGS. 6 and 7, the inclined cam surface 18 is constituted by an end face cam formed on the end surface of a cylindrical portion 19*a* of a bottomed inner tube 19 fitted and fixed in the cylindrical portion 8. The inner tube 19 is fitted and fixed in the cylindrical portion 8. The inclined cam surface 18 has a shape obtained by cutting the tip end of the cylindrical portion 19*a* of the inner tube 19 substantially obliquely with respect to the center axis line L. A recessed groove 20 is provided in a top portion 18*a* of the inclined cam surface 18, and into the recessed groove, a portion excluding the tip portion of the longest ridge 17-1 is fitted. In a base portion 18*b* of the inclined cam surface, an entering groove 21 is provided. The entering groove is configured such that the protrusion 9 of the male body A can enter and is oriented in the direction of the center axis line L.

The length of the longest ridge 17-1 in the direction of the center axis line L is set to such a length that when this ridge is fitted into the recessed groove 20 of the inclined cam surface 18, the distal end portion thereof protrudes from the recessed groove 20.

The length of the other ridges 17 in the direction of the center axis line L are set such that a gap is formed between the ridge and the inclined cam surface which allows the protrusion 9 to move in the circumferential direction of the female body B. That is, when the inner tube 19 is fitted and fixed in the cylindrical portion 8 of the female body B such that the longest ridge 17-1 is fitted into the recessed groove 20, the gap is formed between each ridge 17 and the inclined cam surface 18 in the direction of the center axis line L which is enough for the protrusion 9 to pass in the circumferential direction of the female body B.

As mentioned above, the distal end portion of the longest ridge 17-1 is configured to be continuous with the top portion 18*a* of the inclined cam surface 18. Thereby, as indicated by the double-dashed chain arrow in FIG. 7, the protrusion 9 of the inserting portion 7 of the male body A is guided along any one of side of ridges 17 and 17-1 which are continued to the top portion 18*a* of the inclined cam surface 18 and is further guided smoothly along the inclined cam surface 18.

Further, since the gap in the axial direction between all the ridges 17 and 17-1 in the cylindrical portion 8 and one inclined cam surface 18 can be made small, the length of the axial direction of the female body B can be made small.

The inner tube 19 can be integrally formed with the cylindrical portion 8 of the socket body 6. Moreover, like a modification of the cylindrical portion 8 and the inner tube 19 shown in FIG. 8, a gap in the axial direction that allows the protrusion 9 to pass in the circumferential direction of the cylindrical portion 8 may be formed between all the ridges 17 and one inclined cam surface 18. As a result, the recessed groove 20 in the top portion 18*a* of the inclined cam surface 18 can be omitted, and the top portion 18*a* of the inclined cam surface 18 can be made into the sharp pointed shaped.

Figure 8:
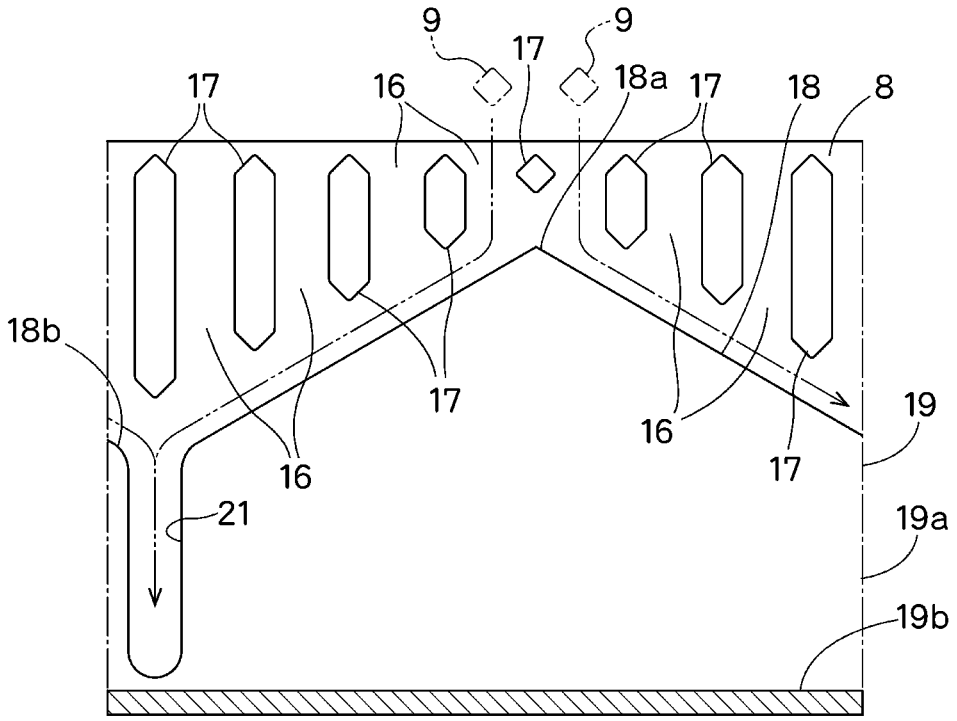
FIG. 8 is a developed view showing a modification of the cylindrical portion and the inner tube.

If it constitutes as shown in FIG. 8, when the protrusion 9 slide along the inclined cam surface 18 of the female body B, after the protrusion 9 has passed through the groove 16 between the ridges 17, 17 on the inner surface of the cylindrical portion 8, sliding the protrusion 9 is not prevent by the ridge 17.

As shown in FIGS. 2 and 10, the pin 22 is formed in a bottom wall 19*b* which closes the proximal end of the cylindrical portion 19*a* of the inner tube 19. That is, five pins 22 corresponding to the five pin insertion holes 10 of the inserting portion 7 of the male body are provided facing to the pin insertion hole 10 and penetrating the bottom wall 19*b* in the axial direction. An enlarged collar portion 22*a* for retaining is provided at an intermediate portion of each pin 22.

The positional relationship between each pin insertion hole 10 and each pin 22 is adjusted to be aligned when the male body A and the female body B are positioned at the regular position. That is, when the inserting portion 7 is inserted into the cylindrical portion 8 and the male body A and the female body B are positioned at the regular positions in the rotational direction around the center axis line L where the protrusion 9 of the inserting portion 7 engages with the entering groove 21 of the inclined cam surface 18, each pin insertion hole 10 and each pin 22 are aligned each other.

As shown in FIGS. 1 and 6, on the outer circumferential surface of the proximal end portion of the inner tube 19, one pair of outward positioning projections 23, 23 and one pair of outward retaining claws 24, 24 are provided in the circumferential direction at appropriate intervals.

One pair of recessed grooves 25, 25 and one pair of engaging holes 26, 26 are provided in the proximal end portion of the cylindrical portion 8. Outward positioning projections 23, 23 of the inner tube 19 are engaged with the pair of recessed grooves 25, 25 in the circumferential direction. Outwardly facing retaining claws 24, 24 of the inner tube 19 are elastically engaged with the pair of engaging holes 26, 26 in the axial direction.

Cut grooves 27, 27 are provided in the both sides of engaging holes 26 of the proximal end portion of the cylindrical portion 8. These cut grooves are configured such that the part of the cylindrical portion 8 where each of the engaging holes 26 is provided can be easily elastically deformed in the diameter expansion direction.

The inner tube 19 can be correctly positioned and fitted easily in the cylindrical portion 8 and can be prevented from coming out. That is, the pair of outwardly positioning projections 23, 23 of the inner tube 19 are pushed into the cylindrical portion 8 from the proximal end portion for engaging with the recessed grooves 25, 25 at the base end portion of the cylindrical portion 8, respectively. Thereby, the pair of outward retaining claws 24, 24 of the inner tube 19 elastically deforms the cylindrical portion 8 where each engaging hole 26 is provided to the outward, then, each engagement claw elastically engages with each engaging hole 26.

The socket body 6 is attached to an electronic device etc. (not shown) in such a manner that the enlarged collar part 5 of the socket body comes into contact with the outer surface of a case of the electronic device in such a manner that it comes into contact with the case, via an O ring (not shown) or the like if necessary. Moreover, each of electrical wiring (not shown) of inside of the electronic device etc. is connected to the proximal end portion of each pin 22 projected into the case from the socket body 6.

Each pin 22 of the socket body 6 is made of a conductor, and the other component of the socket body are made of an insulator, preferably a synthetic resin material.

An electric connecting means (symbol omitted) is formed by plural female contactor 11 of the male body A, and plural pins 22 of the female body B.

In addition, the connecting means can also be replaced with an optical connecting means (not shown) for an optical fiber cable (not shown) equipped with plural optical fibers, or a fluid connecting means for piping connection for fluid (not shown), for example.

Next, how to connect/disconnect the connector will be explained.

For connecting the plug 1 and the socket 2, while gripping the plug case 3 of the plug 1, the inserting portion 7 of the plug body 4 is inserted into the cylindrical portion 8 of the socket 2. Since the distal end portion of the inside of the cylindrical portion 8 is cut off the corners, it is easy to insert the tip of the inserting portion 7 into the cylindrical portion 8.

When the protrusion 9 of the inserting portion 7 slightly enters or substantially enters in to one of the grooves 16 in the cylindrical portion 8, at the same time, the protrusion 9 enters in to one of the grooves in the cylindrical portion 8, whatever the protrusion 9 is positioned around the center axis line L. The inserting portion 7 can enter in to the cylindrical portion 8 in a state in which the position around the center axis line L is positioned, and then the plug body 4 and the socket body 6 can be smoothly fit together in a state where the plug body and the socket body are aligned.

That is, even if the center axis line L of the plug 1 and the socket 2 are slightly misaligned or inclined with respect to the center axis line L, the deviation and inclination thereof are corrected, and the inserting portion 7 can enter smoothly into the cylindrical portion 8.

Then, if the inserting portion 7 is inserted still more deeply in the cylindrical portion 8, as can be understood from FIGS. 7 and 8, the protrusion 9 is disengaged from the groove 16 in the cylindrical portion 8 and abuts on the inclined cam surface 18, and thereafter, the protrusion slides along the inclined cam surface. By the reaction of sliding the protrusion, the plug body 4 is inserted into the socket body 6 while rotating relative to the socket body.

On this situation, the gripped plug case 3 does not rotate, and only the plug body 4 is rotated within the plug case 3.

Also, due to the rotation of the plug body 4, the multi-conductor cable 13 is slightly twisted.

For example, as indicated by a two-dot chain line in FIG. 7, the protrusion 9 that has entered into any one of the grooves 16 on both sides of the ridge 17, 17-1 are guided smoothly while sliding along the inclined cam surface 18 as soon as the protrusion is moved away from the side surfaces of the ridges 17, 17-1.

If the protrusion 9 slide along the inclined cam surface 18 and it goes into the entering groove 21 in the inclined cam surface 18, the positions of the plug body 4 and the socket body 6 are corrected to the regular positions around the center axis line L. In this state, when the inserting portion 7 is further deeply inserted into the cylindrical portion 8, while the protrusion 9 deeply enters in to the entering groove 21, each pin 22 enters in to the corresponding pin insertion hole 10, and each pin contacts with the female contact 11. When the plug 1 is completely inserted into the socket 2, the connecting means is properly electrically connected in the regular positional relationship.

As can be understood from FIG. 10, in a state immediately before the plug 1 is completely inserted into the socket 2, the distal end portion of the cylindrical portion 8 enters in to the space formed between the inserting portion 7 of the plug body 4 and the distal end portion of the outer tube 15. When the plug 1 is completely inserted into the socket 2, the outwardly facing annular projection 8*a* provided at the tip portion of the cylindrical portion 8 elastically engages with the inwardly facing annular projection 15*b* on the inner surface of the outer tube 15. Thereby, the plug 1 can be prevented from coming out from the socket 2.

The elastic engagement between the outwardly facing annular projection 8*a* and the inwardly annular projection 15*b* is realized by expanding the tip portion of the outer tube 15 of the plug body 4 by elastic deformation, reducing in diameter of the tip portion of the cylindrical portion 8 of the socket body 6 by elastic deformation or both of expanding and reducing.

Figure 9:
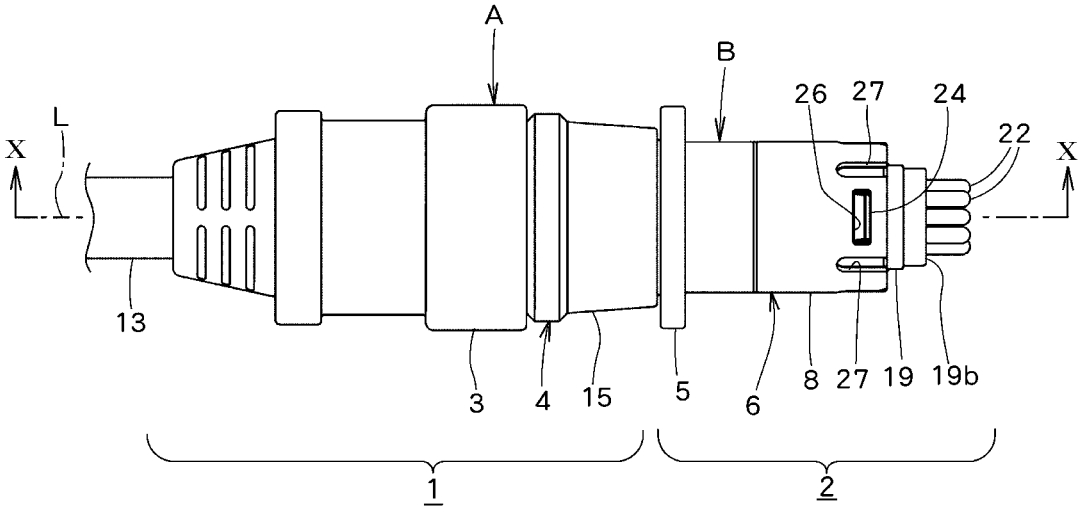
FIG. 9 is a plan view of the connector of the embodiment shown in FIG. 1 in which the plug is completely inserted in the socket.

The state where the plug 1 is completely inserted into the socket 2 is shown in FIGS. 9 and 10.

As mentioned above, even if the plug 1 is inserted to the socket 2 in any rotational direction, the plug body 4 and the socket body 6 are guided into the regular position smoothly, so that the connection can be achieved simply and swiftly by work of fumbling even if the connection point between the plug 1 and socket 2 is not visible.

Moreover, before the protrusion 9 of the inserting portion 7 of the plug body 4 abuts against the inclined cam surface 18 of the cylindrical portion 8 of the socket body 6, the protrusion 9 of the plug body 4 enters into one of the grooves 16 formed between the plurality of ridges 17 on the inner surface of the cylindrical portion 8 of the socket body 6. In such a state in which the protrusion 9 slightly enters in to the socket body 6, mutual inclination of the plug body 4 and the socket body 6 is corrected, and a certain degree of alignment is performed. As a result, the protrusion 9 of the plug body 4 can always be abut with the inclined cam surface 18 of the socket body 6 with a fixed correct posture. Therefore, wear, breakage, and the like due to partial contact of the plug body 4 and the socket body 6 during insertion are prevented.

Furthermore, since it is unnecessary to provide a large diameter center pin and a pin insertion hole on opposing faces of the front end of the inserting portion 7 of the plug body 4 and the cylindrical portion 8 of the socket body 6, as described in US 2017/0062978 A1, the entirety of the opposing faces can be used for connecting means. Therefore, the overall outer diameter of the connector can be reduced.

In order to remove the plug 1 from the socket 2, it is only necessary, while gripping the plug case 3, to pull the plug 1 away from the socket 2 against the resistance force due to the elastic engagement between the outward facing annular projection 8*a* and the inward annular projection 15*b*.

At the beginning of drawing the plug, the five pins 22 are separated from the female contacts 11 and separated from the pin insertion holes 10. As a result, the connecting state of the connecting means is released, and at the same time, the protrusion 9 of the inserting portion 7 slides in the direction of the center axis line L along the entering groove 21 of the inclined cam surface 18.

When the protrusion 9 completely comes out of the entering groove 21 of the inclined cam surface 18, due to the returning force due to the twisting which has occurred in the multi-conductor cable 13, the plug body 4 is rotated relative to the socket body 6 until the returning force becomes zero.

Rotation of the plug body 4 at this time is guided by sliding the protrusion 9 of the inserting portion 7 slide along the inclined cam surface 18.

That is, as the protrusion 9 slides along the inclined cam surface 18, the plug body 4 is moved in the extraction direction while rotating with respect to the socket body 6. On this situation, the plug case 3 may be held in a state of being gripped, and it is not necessary to rotate the plug case. What is necessary is just to allow that the plug body 4 rotates within the plug case 3.

When the multi-conductor cable 13 is twisted and the returning force becomes zero, the plug body 4 stops the rotation with respect to the socket body 6, and then, the protrusion 9 enters in to the groove 16 between any two ridges 17, 17.

On this situation, since the proximal end side of the protrusion 9 is sharp pointed shape (since the protrusion 9 is a lozenge), and since the proximal end of each ridge 17 is also the sharp pointed shape, the protrusion 9 is guided smoothly into any one of the grooves 16.

When the protrusion 9 has moved to the top of the inclined cam surface 18 along the inclined cam surface 18, the protrusion 9 is smoothly guided into one of the grooves 16, at the same time as the protrusion apart from the inclined cam surface 18, the protrusion 9 is smoothly guided along one groove 16 among both sides of any of the ridge 17, 17-1.

After the protrusion 9 passes through any one of the grooves 16, the plug 1 is completely disengaged from the socket 2.

Next, a connector according to a second embodiment of the present invention will be explained with reference to FIGS. 11 and 12.

Figure 11:
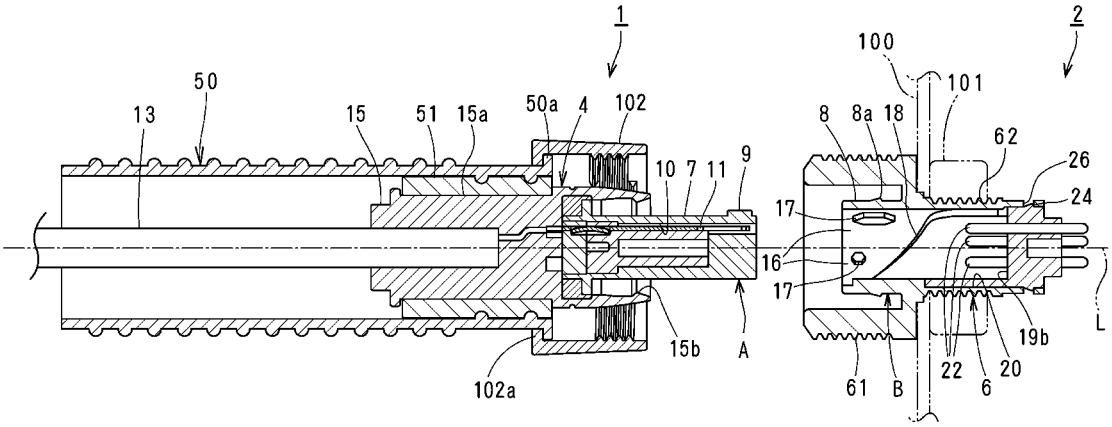
FIG. 11 is a central longitudinal sectional view according to a second embodiment of the present invention showing a state in which a plug and a socket are separated from each other.

FIG. 11 is a central longitudinal sectional view showing a state in which a plug 1 and a socket 2 are separated from each other. FIG. 12 is a central longitudinal sectional view showing a state where the plug 1 is completely inserted into the socket 2.

According to the second embodiment, with respect to an element having the same shape or an element having different shapes but having the same function with the element of the first embodiment, the same reference numeral as used in the first embodiment is used and detailed description is omitted.

When the plug 1 of the second embodiment is compared with the plug 1 of the first embodiment, the plug case 3 of the first embodiment is omitted from the second embodiment, and a cylinder tube 50 and a nut 102 are added. Similarly, when the socket 2 of the second embodiment is compared with the socket 1 of the first embodiment, the enlarged collar part 5 is omitted and an enlarged male thread portion 61 and a reduced male insertion portion 62 are added.

The cylindrical enlarged male insertion portion 61 is formed on the outer circumference of the tip portion of the cylindrical portion 8 in the socket 2. The enlarged male thread portion 61 is while surrounding the tip portion of the cylindrical portion 8 in the socket 2, projecting toward the plug 1 side rather than the tip portion of the cylindrical portion 8. On the outer peripheral surface area of the cylindrical portion 8, the reduced male insertion portion 62 is formed.

The socket 2 is fixable to a case 100, by inserting the reduced male insertion portion 62 into a mounting hole (not shown) provided in the case 100 such as an electromechanical device, an optical mechanical device, a fluid mechanical device, etc., then screwing a nut 101 onto the reduced male insertion portion 62, and binding tight them from the inner side of the case 100.

The cylinder tube 50 which has a predetermined length at least longer than the length of the plug body 4 in the direction of axis line L is rotatably connected to the outer circumference of the plug body 4 of the plug 1. The cylinder tube 50 is made of a metal, a synthetic hard resin material or a flexible material and inside which an electrical, an optical or a fluidic conducting means, connectable to any of the connecting means can be inserted.

A cylindrical hard metal collar 51 is fixed to the inner peripheral surface of the tip portion of the cylinder tube 50. By fitting the collar 51 rotatably around the small diameter portion 15*a*, the cylinder tube 50 is connected to the outer periphery of the plug body 4 in a state that the cylinder tube is rotatable about the center axis line L and can't move in the direction of the center axis line L. In addition, the color 51 may be omitted and the cylinder tube 50 may be connected to the outer circumference of the plug body 4 directly.

An enlarged flange 50*a* is provided on the outer peripheral surface of the tip portion of the cylinder tube 50. An inward flange 102*a* of the nut 102 engages with the enlarged flange 50*a* in the direction of axis line L. Thereby, the nut 102 is supported in a state that relative rotation to the cylinder tube 50 is capable but it is prevented from coming off in the direction of the distal end of the cylinder tube 50.

As in the first embodiment, an electric, an optical or a fluid conducting means connected to any connecting means is connected to the plug body 4. The conducting means extended from the plug body 4 is inserted into the cylinder tube 50. As the conducting means, a multi-conductor cable 13 is shown in FIGS. 11 and 12.

According to the second embodiment, when the plug 1 and the socket 2 are connected to each other, if the vicinity of the tip portion of the cylinder tube 50 or the nut 102 is gripped and inserted the insertion portion 7 of the plug body 4 into the cylindrical portion 8 of the socket body 6, as in the first embodiment, the projecting portion 9 of the insertion portion 7 enters into the cylindrical portion 8 and slides along the inclined cam surface 18.

When the plug body 4 is inserted into the socket body 6 while it is rotating relative to the socket body, the positions of the plug body 4 and the socket body 6 are aligned to the regular positions around the center axis line L. As a result, since the pin 22 enters in to the pin insertion hole 10 and comes in to contact with the female contact 11, the connecting means is electrically connected properly in a regular positional relationship. During this operation, the gripped cylinder tube 50 or the gripped nut 102 does not rotate, and only the plug body 4 is rotated.

Subsequently, the plug 1 and the socket 2 are firmly connected to each other by screwing and tightening the nut 102 on the side of the plug 1 to the enlarged male thread portion 61 of the socket 2.

Figure 12:
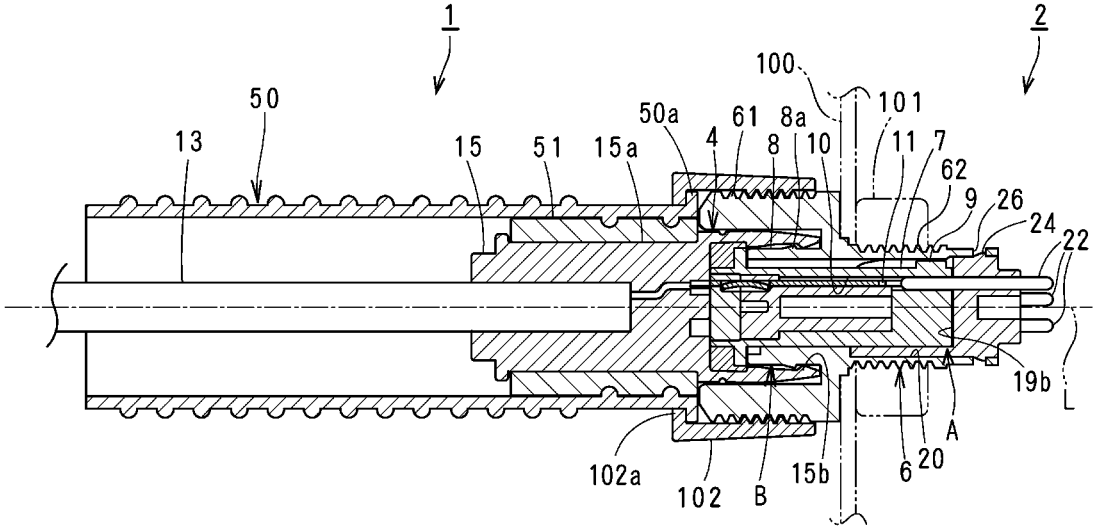
FIG. 12 is a central longitudinal sectional view of the second embodiment in a state where the plug is completely inserted in the socket.

As can be understood from FIG. 12, in the state where the plug 1 and the socket 2 are connected each other, since the cylindrical enlarged male thread portion 61 of the socket 2 enters between the inner peripheral surface of the nut 102 of the plug 1 and the outer peripheral surface of the tip end portion of the plug body 4, the connecting portion between the plug 1 and the socket 2 is surely covered by a labyrinth structure formed by the enlarged male thread portion 61, the nut 102 and the tip portion of the cylinder tube 50.

In order to remove the plug 1 from the socket 2, it is only necessary to turn the nut 102 to releases the nut with the enlarged male insertion portion 61, and while gripping an arbitrary portion of the cylinder tube 50 to pull the plug 1 in the direction away from the socket.

Next, a connector according to a third embodiment of the present invention is explained with reference to FIGS. 13 and 14.

Figure 13:
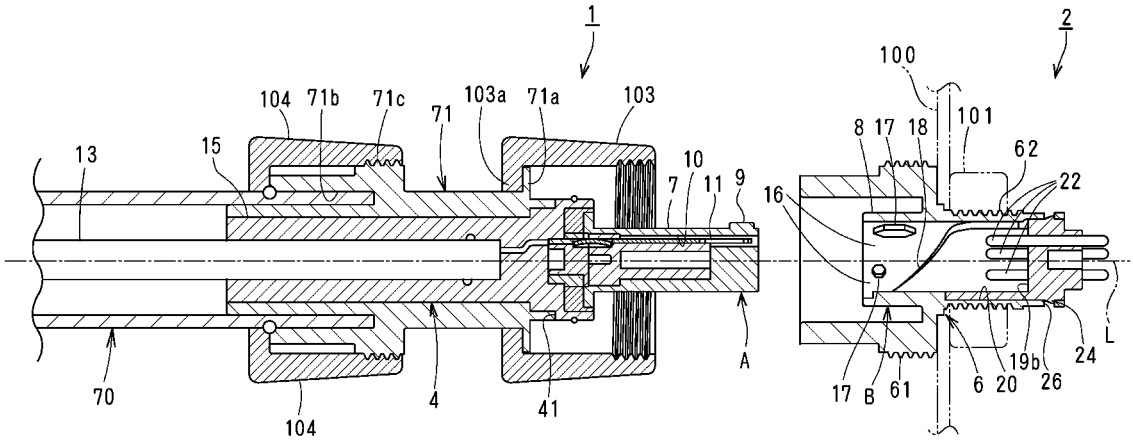
FIG. 13 is a central longitudinal sectional view according to a third embodiment of the present invention showing a state in which a plug and a socket are separated from each other.

FIG. 13 is a central longitudinal sectional view showing a state in which a plug 1 and a socket 2 are separated from each other. FIG. 14 is a central longitudinal sectional view showing a state where the plug 1 is completely inserted into the socket 2.

According to the third embodiment, with respect to an element having the same shape or an element having different shapes but having the same function with the element of the first embodiment, the same reference numeral as used in the first embodiment is used and detailed description is omitted.

When the plug 1 of the third embodiment is compared with the plug 1 of the first embodiment, the plug case 3 and the inward annular projection 15*b* are omitted, and a cylinder tube 70, an auxiliary cylinder tube 71, a first nut 103 and a second nut 104 are added. Similarly, when the socket 2 of the third embodiment is compared with the socket 2 of the first embodiment, the enlarged collar part is omitted and the enlarged male insertion portion 61 and the reduced male insertion portion 62 are added.

In the third embodiment, as in the second embodiment, an example in which the socket 2 is attached to the case 100 and the cylinder tube 70 is connected to the plug 1 is described.

The cylindrical enlarged male insertion portion 61 is formed on the outer circumference of the tip portion of the cylindrical portion 8 in the socket 2. The enlarged male thread portion 61 is while surrounding the tip portion of the cylindrical portion 8 in the socket 2, projecting toward the plug 1 side rather than the tip portion of the cylindrical portion 8. On the outer peripheral surface near the base end portion of the cylindrical portion 8, the reduced male insertion portion 62 is formed.

Further, according to the second embodiment, the threaded portion is formed over the entire area of the enlarged male insertion portion 61 in the axial direction. On the other hand, according to the third embodiment, a threaded portion is formed only in a half area on the proximal end side of the threaded portion in the region near the base end portion of the enlarged male thread portion 61.

The cylinder tube 70 has a predetermined length longer than at least the plug body in the direction of axis line L and is capable of insert in to the electrical, the optical or the fluidic conducting means connected to any of the connecting means. The cylinder tube is made of a metal or a hard material of synthetic resin or a flexible material.

The cylinder tube 70 is rotatably connected to the plug body 4 of the plug 1 via the auxiliary cylinder tube 71. Preferably, the cylinder tube 70 is connected to the auxiliary cylinder tube 71 such that the tip portion of the cylinder tube 70 is inserted into an annular groove 71*b* provided in the auxiliary cylinder tube 71 and the second nut 104 is screwed into a male screw portion 71*c* provided on the outer periphery of the auxiliary cylinder tube 71 and tightened, so that, with respect to the auxiliary cylinder tube 71, the cylinder tube is relatively non-rotatable about the rotation axis line L and is also relatively immovable in the direction of the rotation axis line L. By tightening the second nut 104, since the auxiliary cylinder tube 71 is fixed to the tip portion of the cylinder tube 70, so that the cylinder tube 70 and the auxiliary cylinder tube 71 are substantially integrated.

The auxiliary cylinder tube 71 has an enlarged flange 71*a* on the outer peripheral surface portion of the tip portion, and when connecting the plug 1 to the connector 2, the auxiliary cylinder tube 71 is fitted over the outer periphery of the plug body 4 rotatable around the rotation axis line L and to be movable in the direction of the rotation axis line L. In addition, movement of the auxiliary cylinder tube 71 in the direction of the rotation axis line L of the auxiliary tube 71 relative to the plug body 4 (the direction in which the auxiliary cylinder tube 71 comes out of the distal end portion of the plug body 4, that is, in the right direction in FIGS. 13, 14) is restricted by the tip portion of the auxiliary cylinder tube 71 being engaged with a stepped portion 41 provided on the outer periphery of the plug body 4.

The first nut 103 is externally fitted on the outer periphery of the tip portion of the auxiliary cylinder tube 71 rotatable around the rotation axis line L. An inward flange 103*a* provided on the first nut 103 engages with the enlarged flange 71*a* of the auxiliary cylinder tube 71 in a direction to come out. As a result, the cylinder tube 70 is relatively rotatable around the rotation axis line L with respect to the plug body 4 via the auxiliary cylinder tube 71 and is movable in the direction of the rotation axis line L, until the first nut 103 is screwed with the enlarged male thread portion 61 of the socket 2 and tightened so that the connection between the plug 1 and the socket 2 is completed. Moreover, in the state where the mutual connection between the plug 1 and the socket 2 has completed, the cylinder tube 70 is fixed to the plug body 4 in a state where movement in the direction of the rotation axis line L is impossible.

As in the first embodiment, an electric, an optical or a fluid conducting means connected to any of the connecting means is connected to the plug body 4. The conducting means extended from the plug body 4 is inserted into the cylinder tube 70. As the conducting means, a multi-conductor cable 13 is shown in FIGS. 13 and 14.

According to the third embodiment, when the plug 1 and the socket 2 are connected to each other, by gripping the cylinder tube 70, the auxiliary cylinder tube 71, the first nut 103, or the second nut 104 and inserting the insertion portion 7 of the plug body 4 into the cylindrical portion 8 of the socket body 6, as in the first embodiment, the projecting portion 9 of the insertion portion 7 enters into the cylindrical portion 8 and slides along the inclined cam surface 18, so that the plug body 4 and the socket body 6 are relatively rotated and aligned to a regular position around the center axis line L. As a result, since the pin 22 enters in to the pin insertion hole 10 and comes in to contact with the female contact 11, the connecting means is electrically connected properly in a regular positional relationship. During this operation, the gripped cylinder tube 70 or the gripped auxiliary cylinder tube 71 does not rotate, and only the plug body 4 is rotated.

Subsequently, the plug 1 and the socket 2 are firmly connected to each other by screwing and tightening the first nut 103 on the side of the plug 1 to the enlarged male thread portion 61 of the socket 2.

Figure 14:
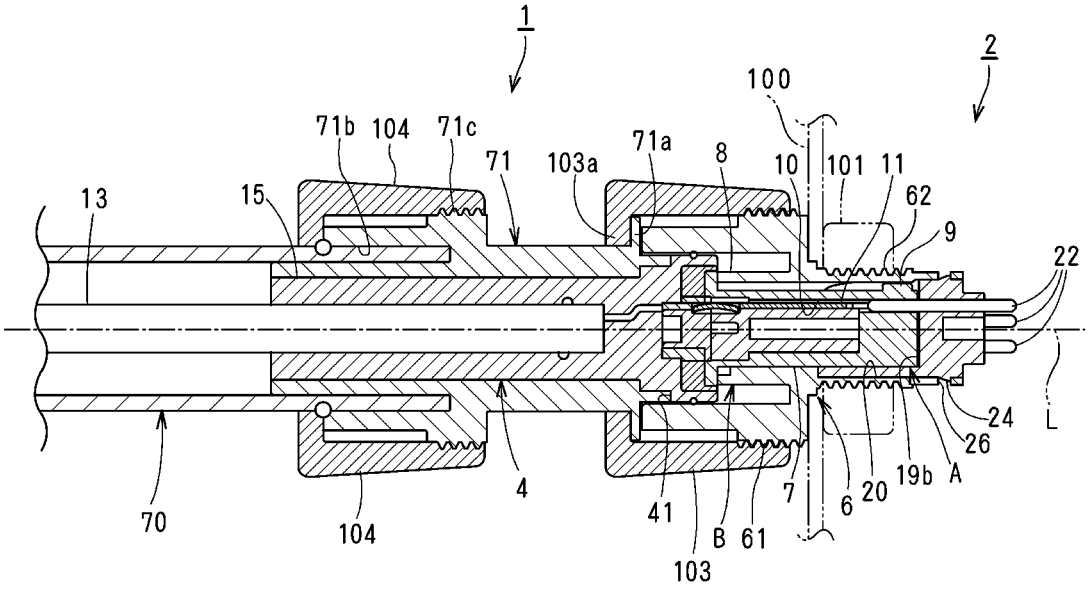
FIG. 14 is a central longitudinal sectional view of the third embodiment in a state where the plug is completely inserted in the socket.

As can be understood from FIG. 14, in the state where the plug 1 and the socket 2 are connected each other, since the cylindrical enlarged male thread portion 61 of the socket 2 enters between the inner peripheral surface of the first nut 103 of the plug 1 and the outer peripheral surface of the distal end portion of the plug body 4, the connecting portion between the plug 1 and the socket 2 is surely covered by a labyrinth structure formed by the enlarged male thread portion 61, the first nut 103 and the tip portion of the enlarged flange 71*a* of the auxiliary cylinder tube 71.

In order to remove the plug 1 from the socket 2, it is only necessary to turn the first nut 103 to releases the nut with the enlarged male insertion portion 61, and while gripping an arbitrary portion of the cylinder tube 70 or the auxiliary cylinder tube 71 to pull the plug 1 in the direction away from the socket.

As mentioned above, in the second and third embodiments, examples in which the socket 2 is attached to the case 100 of device such as an electronic machine tool, an optical machine tool, a fluid machine tool, etc., and the cylinder tube 50 or 70 is rotatably connected to the plug 1 has described. However, the present invention is not limited to such configurations. For example, although not shown, the plug 1 may be fixed to the case 100, while the cylinder tube 50 or 70 may be rotatably connected to the socket 2. Also, among the plug 1 and the socket 2, one of them not connected to the cylinder tubes 50, 70 do not necessarily have to be fixed to the case 100. Moreover, the cylinder tube 50 or 70 may be connected to both of plug 1 and socket 2.

As is apparent from the above description, in the second and the third embodiments of the present invention, the cylinder tube 50 or 70 is rotatably connected to the plug 1, and the conducting means is inserted through the cylinder tube 50 or 70. With such a configuration, it is possible to grasp the cylinder tubes 50 or 70 which are longer than the plug 1 and the socket 2, and even if the plug 1 or the socket 2 is provided in a deep place, the connecting operation between the plug 1 and the socket 2 can be easily performed.

Furthermore, in a state where the plug 1 and the connector 2 are connected to each other, the connecting portion between the plug 1 and the connector 2 is covered with the labyrinth structure, so that, it is possible to make the connection portion inconspicuous, and can be prevented certainly the entry of dust, liquid, etc. into the inside of the connection portion.

Furthermore, in the case where the conducting means is inserted into the cylinder tube 50 or 70 and the conducting means is a hard material optical fiber or the like, the optical fiber may not be a multi-core optical connecting cable, even if the optical fiber is configured using a single cable, since the optical fibers are not dispersed, it is possible to reduce the cost.

Furthermore, when the cylinder tube 50 or 70 is made of a material having flexibility and stretchability, the flexible multi-conductor cable 13 can be deflected and wired within the cable 13 while bending it. Even when the cylinder tubes 50, 70 are bended, the flexible multi-core cable 13 as the conducting means installed inside the cylinder tube can also be bended following the cylinder tubes 50, 70.

The present invention is not limited only to the above embodiments and modifications. The present invention can also be carrying out in the following modified manner, for example.

(1) The socket body 6 is provided on the plug case 3 or the cylinder tubes 50, 70 rotatable around its center axis and incapable of relative movement in the center axis direction.

In this case, the plug body 4 may be fitted to the plug case 3 incapable of relative rotation, or the plug body 4 and the plug case 3 may be integrally formed. That is, at least one of the plug body 4 and the socket body 6 can be rotatable relative to the outer case.

(2) The plug case 3 and the cylinder tubes 50, 70 are omitted. In this case, a worker needs to directly grip the plug body 4 and insert the plug body into the socket body 6. If the position in the rotational direction about the center axis line L of the plug body 4 with respect to the socket body 6 is away from the regular position, the plug body 4 is guided by the sliding movement of the protrusion 9 and the inclined cam surface 18 and is inserted into the socket body 6 while being twisted. Therefore, the worker may twist the finger holding the socket body 6 in order to follow the socket body 6.

(3) A similar member to the multicore cable 13 is connected to the socket 2, and the connector is used as an intermediate connection connector of the multi-core cable.

(4) The plurality of pins 22 are provided on the tip end face of the insertion portion 7 of the plug body 4, while pin insertion holes 10 are provided in the bottom wall 19*b* of the inner tube 19 of the socket body 6 which is the opposing face of the pin.

(5) Any one of the pins 22 is configured by fitting an optical fiber or an optical cable bundled with a plurality of optical fibers into a cylindrical body, an optical connector is provided in the pin insertion hole 10 into which the pin 22 is inserted. By these elements, an optical connecting means is formed. Further, an electrical connecting means is formed by another pin 22 and the female contactor 11 which is a receiving member provided in the pin insertion hole 10. By these the optical connecting means and the electrical connecting means, it is possible to form a hybrid connector capable of simultaneously connecting dissimilar media.

Further, one of the plurality of pins 22 may be a pipe through which a gas flow or a liquid flow, and a pipe joint may be provided in the pin insertion hole 10 into which the pin 22 is inserted, and a fluid connecting means may be included.

(6) In the second or the third embodiments, as a connection structure for finally connecting the plug 1 and the socket 2 together, a structure in which a nut as a connecting member is screwed into the male screw portion has been described (In the second embodiment, the structure in which the nut 102 is screwed to the enlarged male insertion portion 61, in the third embodiment, the structure in which the first nut 103 is screwed with the enlarged male insertion portion 61). However, the connection structure of the present invention is not limited to the configuration including the nut and the male screw portion. For example, the connection structure may be a bayonet lock. In this case, either one of plug 1 or socket 2 can be provided with a female member which is a connecting member rotatable around the rotation axis line L, and the other member can be provided with a protrusion engageable with the connecting member in the direction of the rotation axis line L.

Although the embodiments of the present invention described above are applied to an electrical connecting means for a multicore cable 13 in which a plurality of core wires 13*a* which are covered conductors are bundled, the present invention is not limited to these embodiments. For example, the present invention can also be applied to a connector for connecting an optical cable bundled with a plurality of optical fibers, or a fluid cable bundling a plurality of tubes for distributing a plurality of gases or liquids.

In those case, the electrical connecting means of each embodiment may be replaced with an optical or a fluid connecting means.

What is claimed is:

1. A connector comprising a plug having a plug body and a socket having a socket body, wherein the plug and the socket are connected to each other by inserting the plug and the socket in an axial direction, wherein either one of the plug body and the socket body is a male body provided with an insertion portion having a circular outer peripheral surface, and the other is a female body provided with a cylindrical portion into which the insertion portion of the male body can rotatably fit into the cylindrical portion, wherein an outward protrusion is provided on a part of outer peripheral surface of a distal end portion of the insertion portion of the male body, wherein a plurality of inward ridges and an inclined cam surface are provided on an inner surface of the cylindrical portion of the female body, wherein a groove through which the outward protrusion can pass in the axial direction is formed between each of the adjacent ridges, wherein, when the insertion portion is inserted into the cylindrical portion in the axial direction and the outward protrusion contacts with the inclined cam surface, the male body and the female body are relatively rotated and are positioned at a regular position in a rotational direction around a center axis line of the connector, wherein a plurality of electrical, optical or fluid connecting means are respectively provided at an opposing portion of the male body and the female body and those connecting means are connected to each other in a state in which the male body and the female body are positioned at a regular position, and wherein at least one of the plug body and the socket body is provided rotatable around a center axis of a cylindrical case and incapable of relatively moving in the central axial direction.

2. The connector according to claim 1, wherein the distal end portions of each of the ridges is formed in a sharp pointed shape, and wherein the distal end portions of the grooves formed between the adjacent ridges are expanded in the circumferential direction of the cylindrical portion of the female body.

3. The connector according to claim 1, wherein a clearance in the axial direction is provided between the ridges on the inner surface of the cylindrical portion of the female body and the inclined cam surface so that the protrusion can pass in the circumferential direction of the cylindrical portion.

4. The connector according to claim 1, wherein at least one of the plurality of ridges is continuous with a top portion of the inclined cam surface.

5. The connector according to claim 1, wherein the connecting means comprises:

one or a plurality of pins are provided on one of the opposing faces of the plug body and the socket body and facing in the axial direction, and wherein one or a plurality of receiving members are provided on the other of the opposing faces and configured partially in contact with the respective pin.

6. A connector comprising a plug, a socket, connecting means, and a cylinder tube, the plug has a cylindrical insertion portion, the socket is configured to be connected to the plug by inserting the insertion portion in an axial direction, the connecting means is an electrical, an optical or a fluid connecting means provided at each of opposed portions of the plug and the socket, wherein the cylinder tube is connected to at least one of the plug and the socket rotatable around the axial direction, wherein the plug has an outward protrusion protruding outward from a part of an outer peripheral surface of a distal end portion of the insertion portion, wherein the socket has a cylindrical portion, a plurality of inwardly extending ridges provided on an inner peripheral surface of the cylindrical portion, and an inclined cam surface provided on an inner peripheral surface of the cylindrical portion, the cylindrical portion is configured such that the insertion portion can be inserted in the axial direction while rotating around the axis line, wherein, between each of the adjacent ridges, a groove through which the outward protrusion can pass in the axial direction is formed, wherein, when the insertion portion is inserted in the cylindrical portion in the axial direction, the protrusion slidably contacts with the inclined cam surface and the socket is rotated relative to the plug so that the socket and the plug are positioned at a regular position in a rotational direction around a center axis line of the connector, wherein, when the plugs and the socket are positioned at the regular position, the connecting means are connected to each other, wherein the cylinder tube has a predetermined length in the axial direction such that any of electrical, optical or fluid conducting means connected to the connecting means can be passed through the cylinder tube, and wherein a connecting member capable of rotating on the outer peripheral surface of the distal end portion around the axis line is provided at the distal end portion of the cylinder tube, and wherein, in a state where the plug and the connector are connected to each other, the connecting member is engaged with an engaging portion provided in the plug or the connector in the axial direction.

7. The connector according to claim 6, wherein the distal end portions of each of the ridges is formed in a sharp pointed shape, and wherein the distal end portions of the grooves formed between the adjacent ridges are expanded in the circumferential direction of the cylindrical portion of the female body.

8. The connector according to claim 6, wherein a clearance in the axial direction is provided between the ridges on the inner surface of the cylindrical portion of the female body and the inclined cam surface so that the protrusion can pass in the circumferential direction of the cylindrical portion.

9. The connector according to claim 6, wherein at least one of the plurality of ridges is continuous with a top portion of the inclined cam surface.

10. The connector according to claim 6, wherein the connecting means comprises:

one or a plurality of pins are provided on one of the opposing faces of the plug body and the socket body and facing in the axial direction, and one or a plurality of receiving members are provided on the other of the opposing faces and configured partially in contact with the respective pin.

* * * * *